US008839539B2

(12) United States Patent
Killian

(10) Patent No.: US 8,839,539 B2
(45) Date of Patent: Sep. 23, 2014

(54) NOTIFICATION BOARD AND LABELING APPARATUS

(76) Inventor: Travis Michael Killian, New York, NY (US)

( * ) Notice: Subject to any disclaimer, the term of this patent is extended or adjusted under 35 U.S.C. 154(b) by 254 days.

(21) Appl. No.: 13/439,236

(22) Filed: Apr. 4, 2012

(65) Prior Publication Data

US 2013/0265211 A1 Oct. 10, 2013

(51) Int. Cl.
*G09F 1/10* (2006.01)
*A47G 1/06* (2006.01)

(52) U.S. Cl.
CPC ..... *A47G 1/06* (2013.01)
USPC ..... 40/657; 40/781; 40/735; 40/618

(58) Field of Classification Search
CPC ..... A47G 1/065; A47G 1/06; A47G 1/0638; A47G 1/0611; G09F 1/12; D06F 93/00; A47F 5/0869; A47F 29/10; A47F 5/0832
USPC ..... 40/781, 657, 735, 618, 620
See application file for complete search history.

(56) References Cited

U.S. PATENT DOCUMENTS

| | | | | | |
|---|---|---|---|---|---|
| 398,953 | A * | 3/1889 | East | 40/727 |
| 1,094,709 | A * | 4/1914 | Faucett | 40/729 |
| 1,692,999 | A * | 11/1928 | Siegel | 40/732 |
| 1,830,506 | A * | 11/1931 | Cowing | 40/607.15 |
| 5,525,370 | A * | 6/1996 | Hoebeke et al. | 427/195 |
| 6,467,210 | B1 * | 10/2002 | Chang | 40/792 |
| 2007/0137081 | A1 * | 6/2007 | Chang | 40/781 |

* cited by examiner

*Primary Examiner* — Casandra Davis
(74) *Attorney, Agent, or Firm* — James M Smedley LLC; James M. Smedley, Esq.

(57) ABSTRACT

The present invention generally relates to a notification boards. Specifically, this invention relates to a notification board configured to organize and display papers, photographs and other documents for viewing. Embodiments of the present invention may include a labeling apparatus configured to describe or otherwise detail the displayed contents of the notification board.

19 Claims, 12 Drawing Sheets

NOTIFICATION BOARD AND LABELING APPARATUS

FIELD OF THE INVENTION

The present invention generally relates to notification boards. Specifically, this invention relates to a notification board configured to organize and display papers, photographs and other documents for viewing. Embodiments of the present invention may include a labeling apparatus configured to describe or otherwise detail the displayed contents of the notification board.

BACKGROUND OF THE INVENTION

The use of notification boards or announcement boards has been ubiquitous in all manners of settings. From schools, workplaces, government buildings and universities to homes and public places, the use of notification boards for the publishing of content relevant to passersby is common practice across all walks of life.

One main issue with standard notification boards is that they are commonly a place where there is no organization or restrictions on the placement of content. Typically consisting of corkboard, magnetic materials or other simple means allowing for documents to be retained upon a surface, notification boards commonly become unorganized messes of content layered upon content with no separation between the various documents and no way to know how long documents have been residing on the notification board or provide other identifying information. Additionally, especially in the case of notification boards that use corkboard or similar material, the attachment means used, such as thumbtacks and staples, frequently damage both the notification board and the documents themselves.

Another issue with standard notification boards is that since there is no demarcation between the documents or space where documents should be placed, individuals end up stacking documents and obscuring the documents previously placed by others. This can commonly lead to messy, unorganized notification boards that actually end up dissuading passersby from coming to view the content placed thereupon.

Therefore, there is a need in the art for a notification board that provides the ability to organize and display documents for viewing and further provide an easy and convenient method for allowing the removal of hard to retrieve documents from each distinct viewing area. These and other features and advantages of the present invention will be explained and will become obvious to one skilled in the art through the summary of the invention that follows.

SUMMARY OF THE INVENTION

Accordingly, embodiments of the present invention are directed to providing a notification board configured to organize and display papers, photographs and other documents for viewing. Embodiments of the present invention may include a labeling apparatus configured to describe or otherwise detail the displayed contents of the notification board.

According to an embodiment of the present invention, a notification board includes: a substantially flat back frame portion comprising a rear side and a front side, wherein said rear side of said substantially flat back frame portion is configured to be attached to a surface via one or more connection means; a front frame portion comprising one or more divider sections, wherein said front frame portion is connected to said front side of said substantially flat back frame portion; one or more display panels, wherein each of said one or more display panels is substantially transparent, wherein each of said one or more display panels are configured to be secured in between one of said one or more divider sections of said front frame portion and said front side of said substantially flat back frame portion; and one or more tension means, wherein each of said one or more tension means is in contact with at least one of said one or more display panels and at least one of said one or more divider sections.

According to an embodiment of the present invention, the front frame portion further comprises one or more labeling components.

According to an embodiment of the present invention, the notification board has an equal number of labeling components and divider sections.

According to an embodiment of the present invention, each of said labeling component is formed in a recess on said one or more divider sections.

According to an embodiment of the present invention, the notification board has exactly one labeling component on each of said one or more divider sections.

According to an embodiment of the present invention, the one or more dividers sections form a single integrated piece.

According to an embodiment of the present invention, the notification board has a space formed between each of said one or more dividers and said front side of said substantially flat back frame portion.

According to an embodiment of the present invention, each space further comprises an open top portion formed by a curved portion located at the top of said divider that forms said space.

According to an embodiment of the present invention, the space is configured to receive one or more documents.

According to an embodiment of the present invention, each of said tension means is configured to place force upon said display panel which said tension means is in contact with in a manner that urges said display panel towards a closed position.

According to an embodiment of the present invention, the tension means are configured to allow opposing force to be applied thereto in order to move said display panel towards an open position.

According to an embodiment of the present invention, the contents located behind said display panel may be removed when said display panel is in said open position.

According to an embodiment of the present invention, the tension means is a spring.

According to an embodiment of the present invention, the tension means is a weight.

According to an embodiment of the present invention, the notification board is further comprised of one or more locking elements, attached to one or more of said one or more display panels and one or more of said divider sections.

According to an embodiment of the present invention, each one of said one or more locking elements is configured to prevent movement of one of the one or more display panels.

According to an embodiment of the present invention, the display panels comprise Lexan® plastic.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
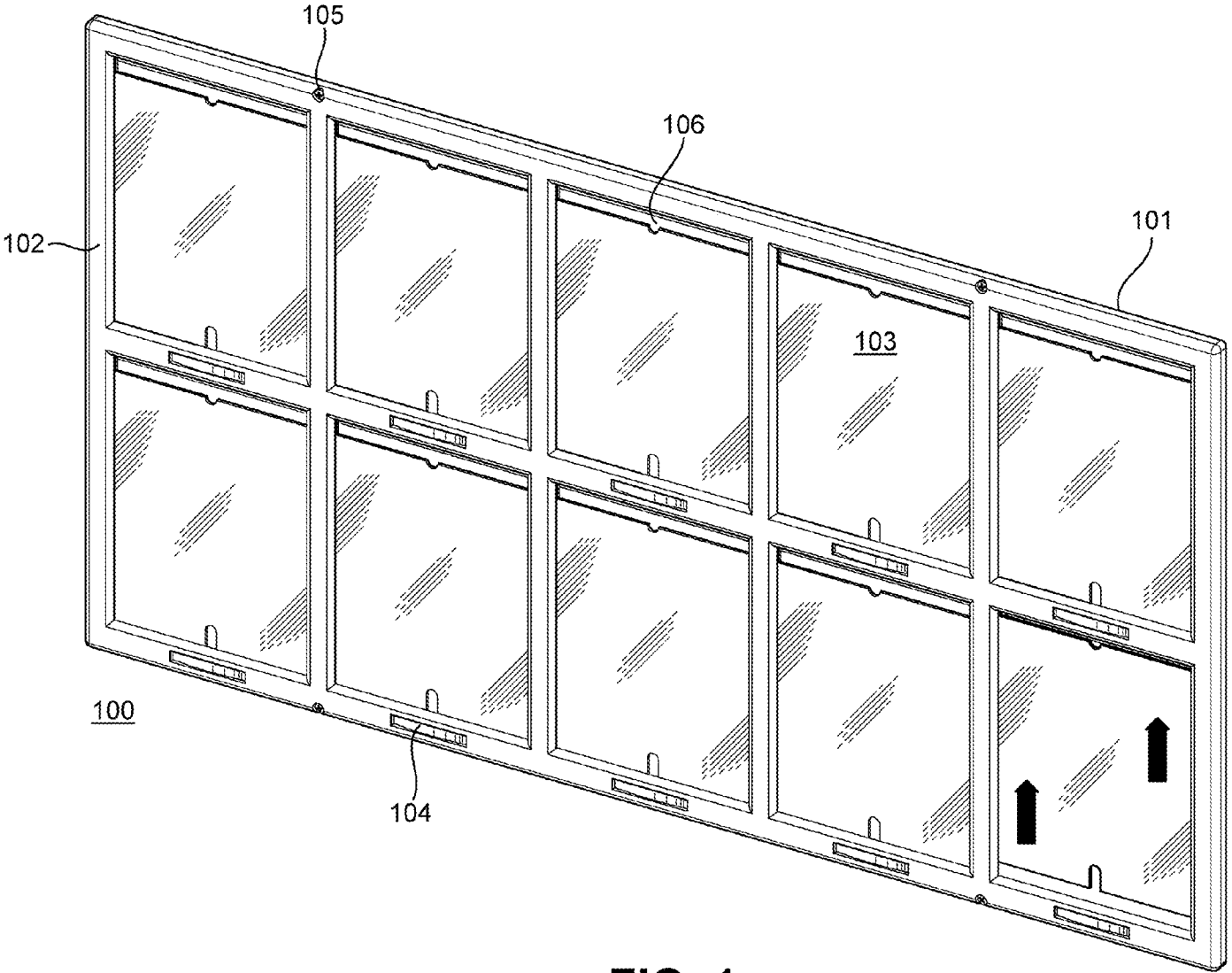
FIG. 1 is a perspective view of a notification board in accordance with an embodiment of the present invention.

The present invention generally relates to notification boards. Specifically, this invention relates to a notification board configured to organize and display papers, photographs and other documents for viewing. Embodiments of the present invention may include a labeling apparatus configured to describe or otherwise detail the displayed contents of the notification board.

According to an embodiment of the present invention, a notification board includes a substantially flat back frame portion, a front frame portion comprising one or more divider sections, one or more display panels and one or more tension means. Combined, these components form a notification board that allows for the retention and display of multiple documents in an organized manner.

According to an embodiment of the present invention, the substantially flat back frame portion is comprised of a rear side and a front side. The rear side of the back frame portion is configured to be attached to a surface via one or more attachment means. In a preferred embodiment, the attachment surface would be a wall or other solid surface that would provide the ability to retain weight of the notification board and its content. Common surfaces include walls, posts, mounting brackets and hanging display brackets. One of ordinary skill in the art would appreciate that there are numerous surfaces embodiments of the present invention could be utilized with, and embodiments of the present invention are contemplated for attachment to any surface.

According to an embodiment of the present invention, the attachment means are configured to be received through a front side of the notification board and into or onto the attachment surface in a manner that affixes the notification board to the surface. Attachment means include, but are not limited to, screws, nails, pins, nuts and bolts, tacks and other fasteners. One of ordinary skill in the art would appreciate that there are numerous attachment means that could be utilized with embodiments of the present invention, and embodiments of the present invention are contemplated for use with any attachment means.

In other embodiments, attachment means are not required to be received through the front side of the notification board. For instance, the attachment means could be comprised of adhesives capable of securing the rear side of the back frame portion to the attachment surface. One of ordinary skill in the art would appreciate there are numerous attachment means that could be utilized in this manner, and embodiments of the present invention are contemplated for use with any form of attachment means.

According to an embodiment of the present invention, the front frame portion of the notification board is comprised of one or more divider sections. Each divider section is formed by a plurality of bars forming a shape that when connected to the front side of the flat back frame portion of the notification board, a space is formed. Examples of this can be seen at least in FIGS. 7, and 12-15 and FIG. 9. In a preferred embodiment, the divider sections are square or rectangular and form a space ideally shaped to retain documents. The documents may be, for instance, papers, letters, legal notices, photographs, flyers or advertisements. One of ordinary skill in the art would appreciate that embodiments of the present invention could be utilized to retain any manner of documents, and embodiments of the present invention are contemplated for use with the retention of any type of document.

According to an embodiment of the present invention, given the shape and size of the divider sections and the space formed therein, documents retained in the space of the divider section are maintained in an upright and clearly viewable manner. Advantageously, documents are prevented from folding over or otherwise becoming unreadable due to positioning or placement.

According to an embodiment of the present invention, one or more display panels are secured in between the divider sections of the front frame portion and the front side of the flat back frame portion of the notification board. This display panel works to keep the documents in place within the space defined between the divider sections and the front side of the flat back frame portion. In a preferred embodiment, these components work to form a space that is enclosed on all sides except for an opening on top that allows for the easy insertion and removal of documents into the space. Ideally, the display panels are comprised of a transparent or semi-transparent material, such as polycarbonate plastic (for example, Lexan®), glass or acrylic glass (such as Plexiglas®). However, in certain embodiments, it may be desirable to have non-transparent materials used. One of ordinary skill in the art would appreciate there are numerous materials of various transparency from which the display panels could be constructed from, and embodiments of the present invention are contemplated for use with display panels of any material and any transparency.

According to an embodiment of the present invention, each space has an open top portion formed by a curved portion located at the top of said divider that forms said space. In this manner, documents may be easily inserted and removed from the top of each space. In other embodiments, there are no openings and documents are inserted and retrieved via other means described below.

According to an embodiment of the present invention, each divider section and display panel combination is in contact with a tension means. The tension means is configured to provide a force on the display panel to urge the display panel towards a closed position. Users of the notification board may apply a counter force in the opposite direction to move the display panel to an open position. In a closed position, the space formed between the display panel, back frame portion and divider section is ideal for retaining documents therein. In an open position, easy access to documents within the space is provided. This is useful when documents that are placed into the space are otherwise hard to retrieve.

According to an embodiment of the present invention, the tension means may be a leaf spring, coil spring, weighted element, magnetic element or other means for urging the display panel towards a closed position. One of ordinary skill in the art would appreciate that there are numerous tension means that could be used with embodiments of the present invention, and embodiments of the present invention are contemplated for use with any tension means.

According to an embodiment of the present invention, the notification board could be further comprised of one or more labeling components. The labeling component is configured to allow for users of the notification board to identify and label the contents of the various divided sections and the documents contained therein. In a preferred embodiment of the present invention, the labeling component is built into the front frame portion, with one label component below each of the various divided sections. In this preferred embodiment, a label is inserted on one side and is bent and inserted in the other side. The curved backing makes the label stay in place with compression force occurring in the label component. In a preferred embodiment of the present invention, the notification board has an equal number of labeling components and divider sections, allowing for each divided section to be appropriately labeled.

According to an embodiment of the present invention, the notification board has exactly one labeling component on each of said one or more divider sections.

According to an embodiment of the present invention, the front frame portion and the various dividers sections form a single integrated piece. The entire single integrated piece is configured to be attached to the back frame portion via one or more attachment means. Commonly, screws or plastic fusing techniques may be utilized. However, one of ordinary skill in the art would appreciate there are numerous attachment means that may be utilized to secure the single integrated front frame portion to the back frame portion of the notification board, and embodiments of the present invention are contemplated for use with any attachment means.

According to an embodiment of the present invention, the notification board is further comprised of one or more locking elements. The locking elements may, for instance, be comprised of a first element attached to a display panel and a second element attached to the front frame portion of the notification board. The locking element may be utilized to further secure the display panel in a closed position or to otherwise protect documents contained within the notification board. Locking elements may include, but are not limited to, latches, key locks, combination locks, hook and loops, tie down elements and tongue and groove elements. One of ordinary skill in the art would appreciate that there are numerous locking elements that may be utilized with embodiments of the present invention, and embodiments of the present invention are contemplated for use with any locking elements.

Turning now to FIG. 1, a perspective view of an exemplary embodiments of the present invention is shown. In this FIG. 1, a notification board 100 with a back frame portion 101 and a front frame portion 102 that, in combination, form ten divider sections. Additionally in FIG. 1, the notification board 100 is comprised of ten display panels 103, ten labeling systems 104 and 4 attachment means 105 is shown. In this embodiment, each of the divider sections 102 is the same size. This goes for the labeling systems 104 and display panels 103 as well. One of ordinary skill in the art would appreciate that the divider sections 102, labeling systems 104 and display panels 103 may vary in size, providing a notification board 100 with multiple sizes and shapes of divider sections 102 and labeling systems 104.

Additionally in FIG. 1, the opening 106 at the top of each divided section can be seen, whereby documents can be inserted into the opening for retention and display in the space below. The document can be later removed from the top, or, alternatively, from the bottom by applying an upward force to the display panel, thereby moving the display panel into an open position and allowing for the document to be retrieved from the bottom.

Figure 2:
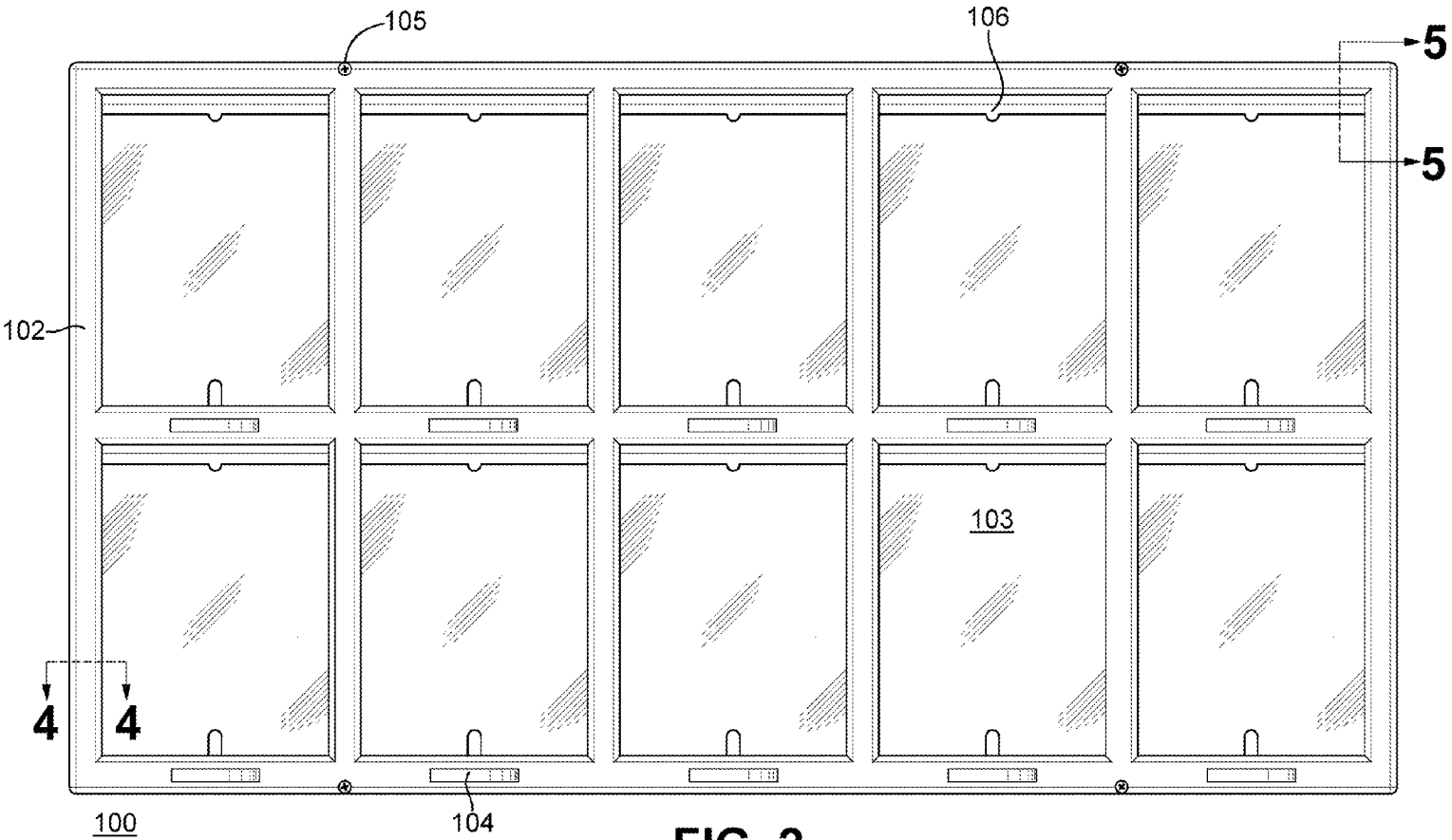
FIG. 2 is a front view of a notification board in accordance with an embodiment of the present invention.
Figure 3:
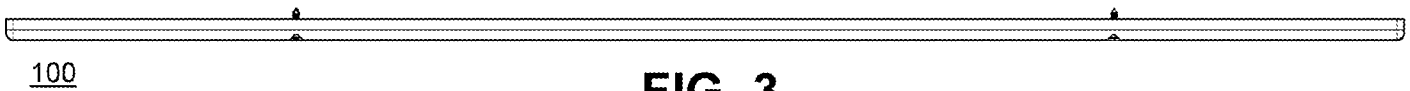
FIG. 3 is a top view of a notification board in accordance with an embodiment of the present invention.

FIGS. 2-3 show alternate views of the embodiment of the notification board as shown in FIG. 1. Again, ten divided sections 102 are shown, with ten display panels 103 ten labeling systems 104, and 4 attachment means 105.

Figure 4:
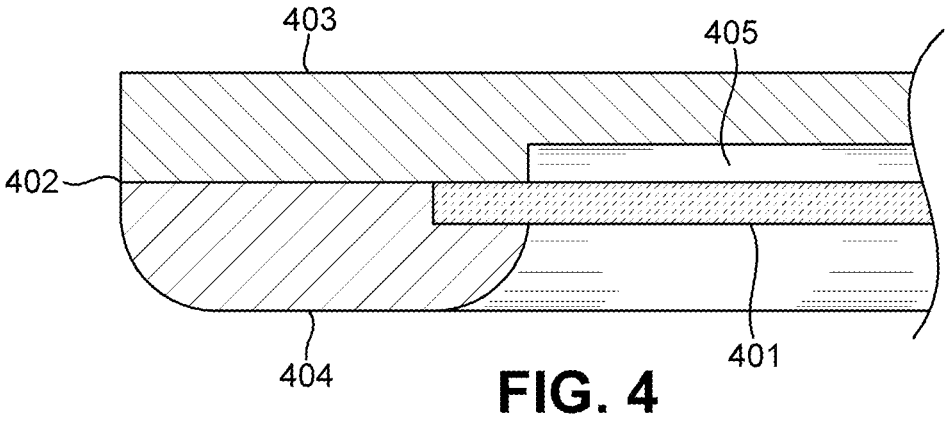
FIG. 4 is a cross-sectional view of a notification board in accordance with an embodiment of the present invention.

FIG. 4 shows a cross-sectional view of a divided section with the display panel 401 in a closed position. In an exemplary embodiment, the display panel is received within a channel 402 formed between the back frame portion 403 and the front frame portion 404. This provides stability and control such that the display panel 401 does not wobble or otherwise become loose while the display panel 401 moves up and down within the given space provided in said channel 402. Also shown is the space 405 formed behind the display panel 401 which is capable of retaining documents therein while the display panel is in a closed position.

Figure 5:
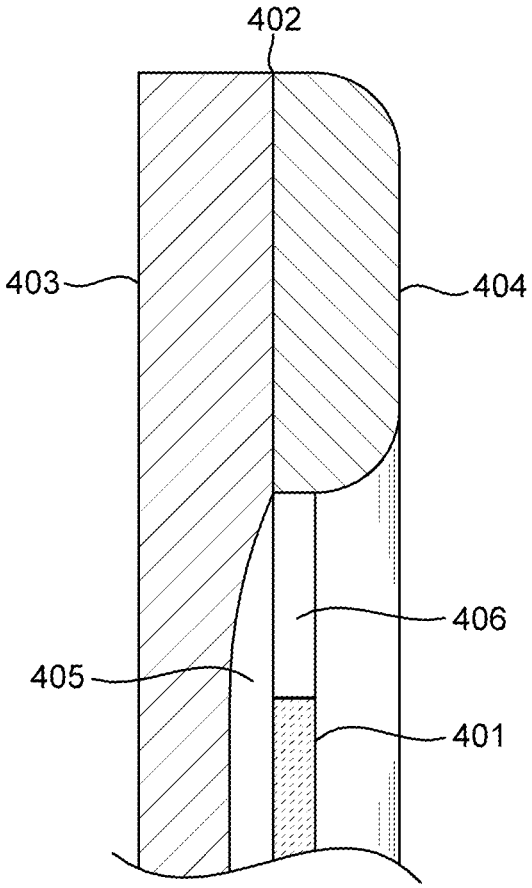
FIG. 5 is a cross-sectional view of a notification board in accordance with an embodiment of the present invention.

FIG. 5 shows a cross-sectional view of a divided section with the display panel 401 in an closed position. In this exemplary embodiment, the display panel is received within a channel 402 formed between the back frame portion 403 and the front frame portion 404. In this closed position, documents may be inserted into the curved portion located at the top or removed from the space 405 behind the display panel by reaching in and pulling out the document through the gap 406 provided. It should be noted that, in preferred embodiments of the present invention, when the display panel is in a closed position, documents may be inserted and/or retrieved from the top of the divided section as a curved portion located at the top 406 is left open when the display panel is in the closed position.

In an open position, documents may be removed from a gap formed at the bottom of a divided section. The gap is formed when the display panel is slid up within the given space provided in said channel 402. In certain embodiments, the curved portion located at the top may become closed when the display panel is moved into the open position to give access to documents from the bottom.

Figure 6:
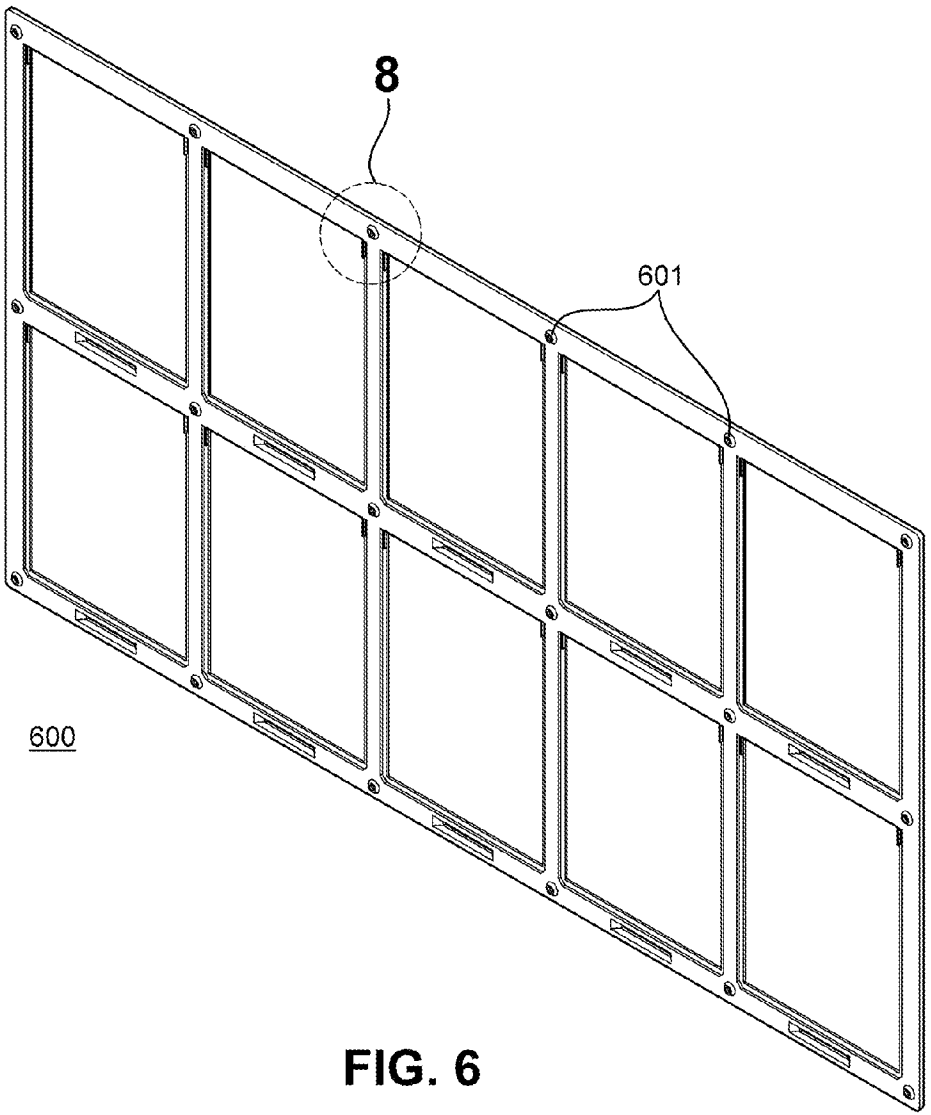
FIG. 6 is a rear perspective view of a front frame portion of a notification board in accordance with an embodiment of the present invention.
Figure 7:
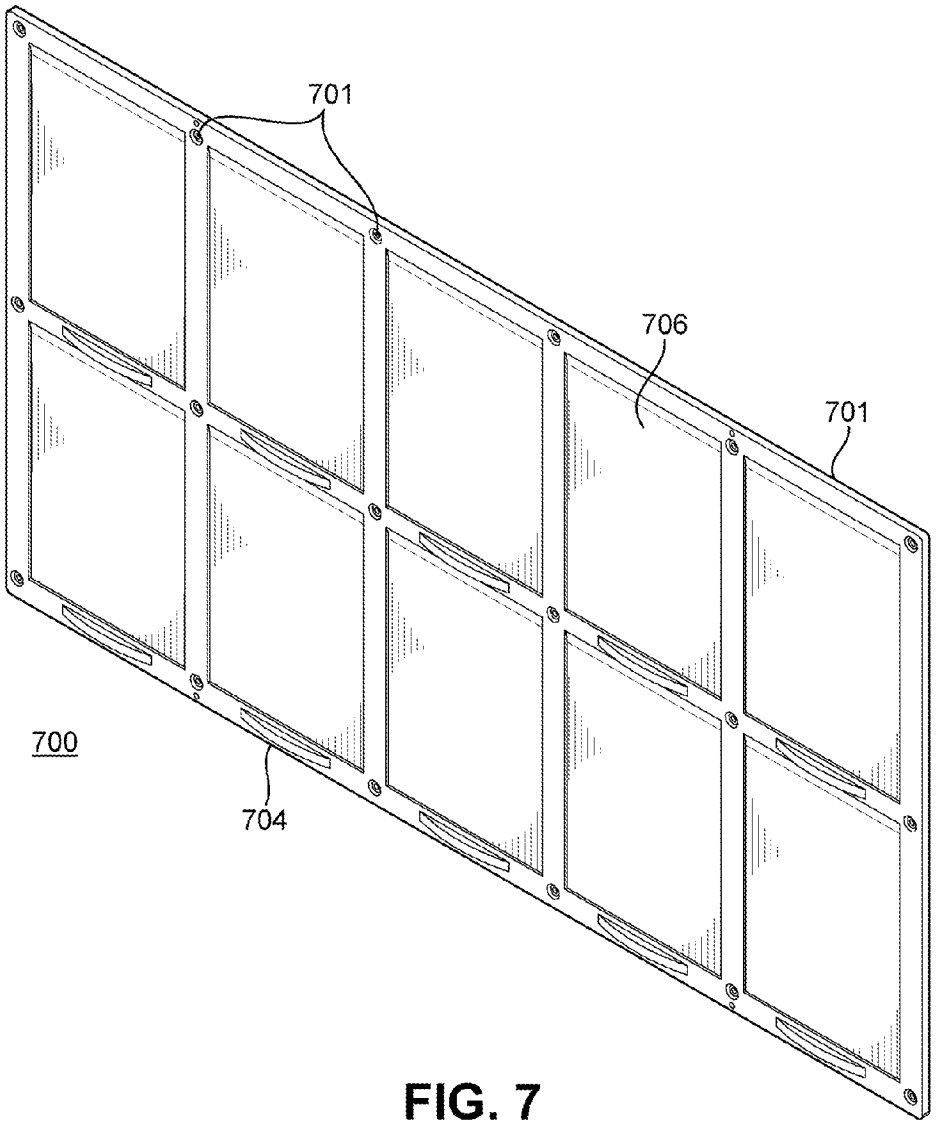
FIG. 7 is a front perspective view of a back frame portion of a notification board in accordance with an embodiment of the present invention.
Figure 8:
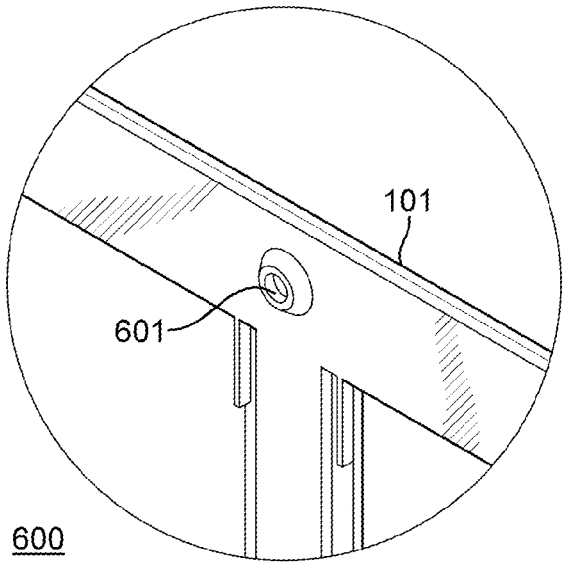
FIG. 8 is a detailed view of an attachment means of a front frame portion of a notification board in accordance with an embodiment of the present invention.

Turning now to FIGS. 6-8 views of the frame of a notification board (front frame portion 600 and back frame portion 700) are shown (FIG. 6 being a rear perspective view of the front frame portion 600, FIG. 7 being a front perspective view of a back frame portion, and FIG. 8 being a close-up of an attachment means 601 of a front frame portion 600). In these views, the numerous attachment means 601 are shown as well as recessed areas 701 for receiving one or more attachment means 601. These attachment means 601 are used to attach the front frame portion 600 to the back frame portion 700 of the notification board as previously described herein. In a preferred embodiment, the recessed areas 701 are configured to receive a coned area attachment means 601. In certain embodiments of the present invention, no recessed areas 701 are utilized.

Figure 9:
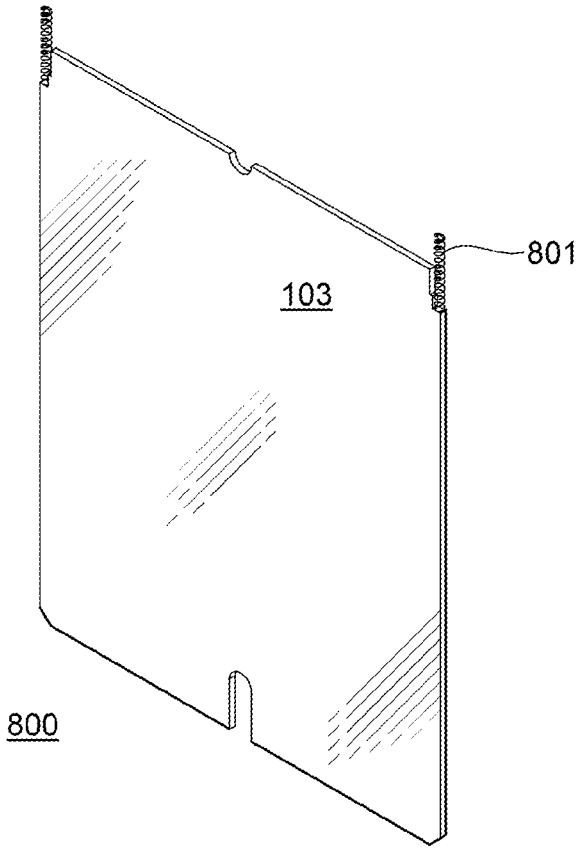
FIG. 9 is a perspective view of a display panel in accordance with an embodiment of the present invention.

FIG. 9 shows a display panel 800, in accordance with an exemplary embodiment of the present invention. The display panel has two tension means 801 in line with it, one tension means at either top end of the display panel. In this embodiment, the tension means are springs and are configured to provide downward force on the display panel in order to urge the display panel into a closed position.

Figure 10:
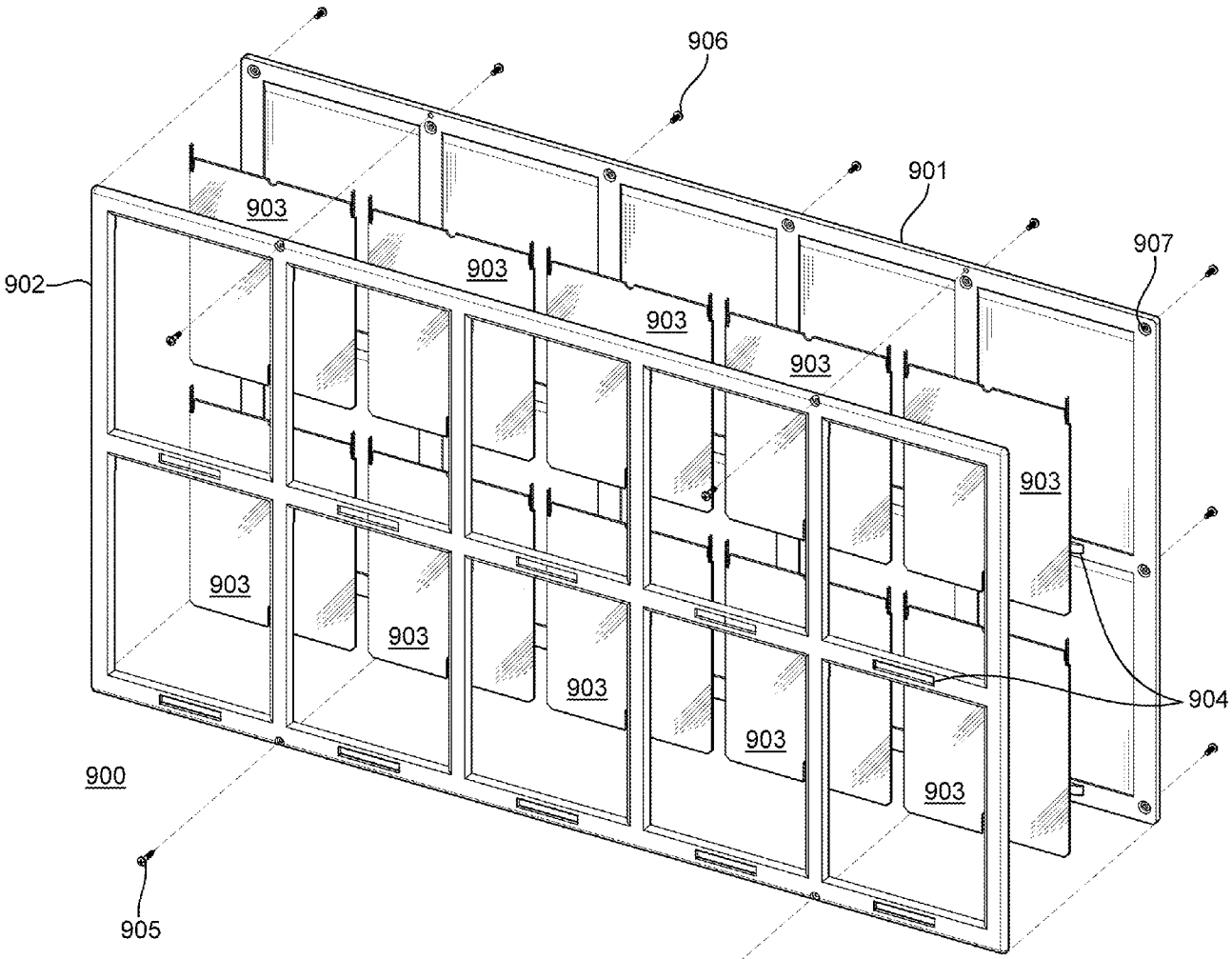
FIG. 10 is an exploded view of a notification board in accordance with an embodiment of the present invention.
Figure 11:
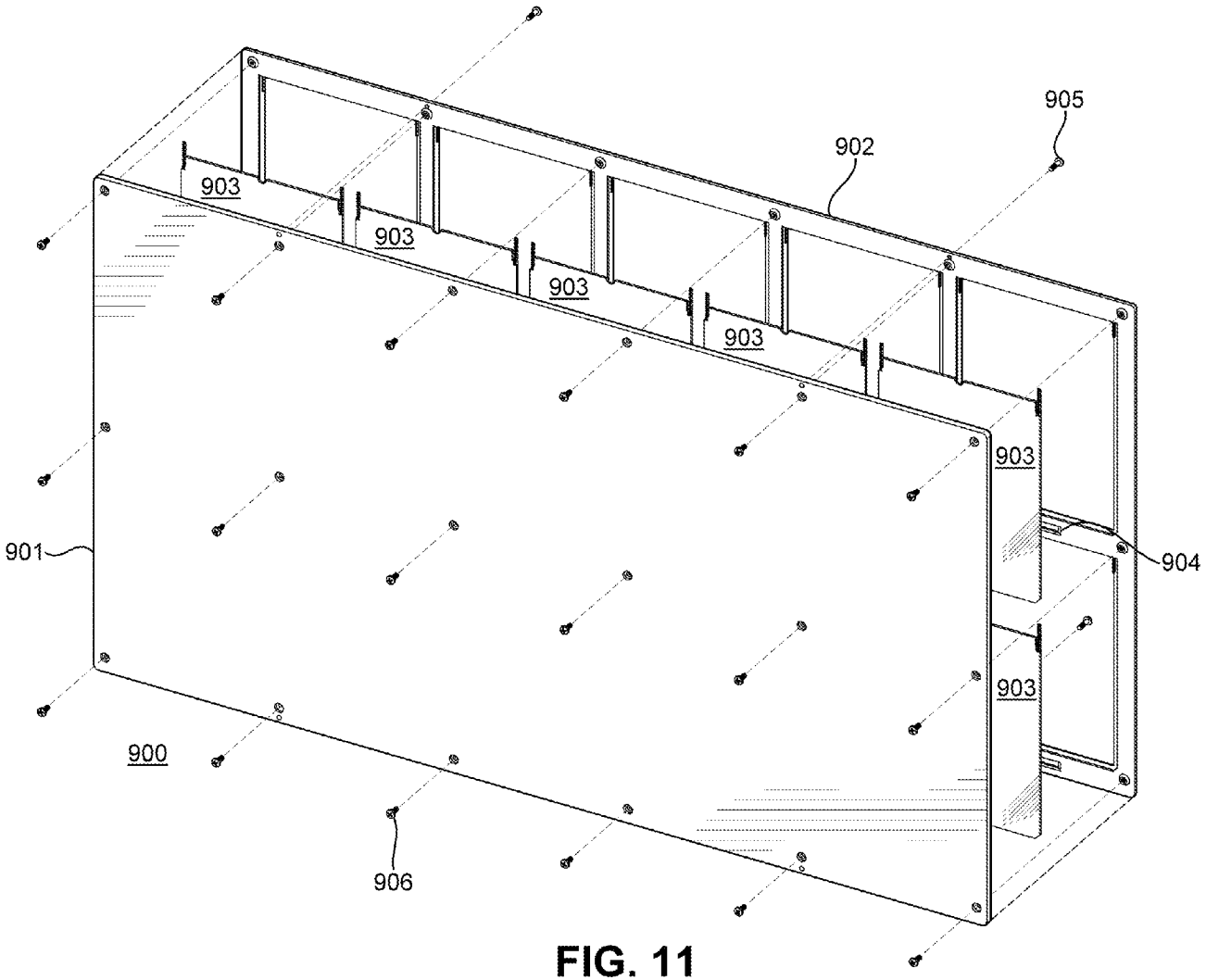
FIG. 11 is an exploded view of the rear of a notification board in accordance with an embodiment of the present invention.

FIGS. 10-11 shows exploded views of an exemplary embodiment of the notification board 900 of the present invention (FIG. 10 being a front exploded view and FIG. 11 being a rear exploded view). In this embodiment, each of the elements (i.e., back frame portion 901, front frame portion 902, display panel 903, labeling system 904, surface attachment means 905, frame attachment means 906 and frame attachment means recessed receiving areas 907) are aligned in such a manner that when assembled, ten separate divided sections are formed whereby each divided section is capable of retaining one or more documents therein. In this collective manner, documents can be organized and retained in an orderly fashion.

Figure 12:
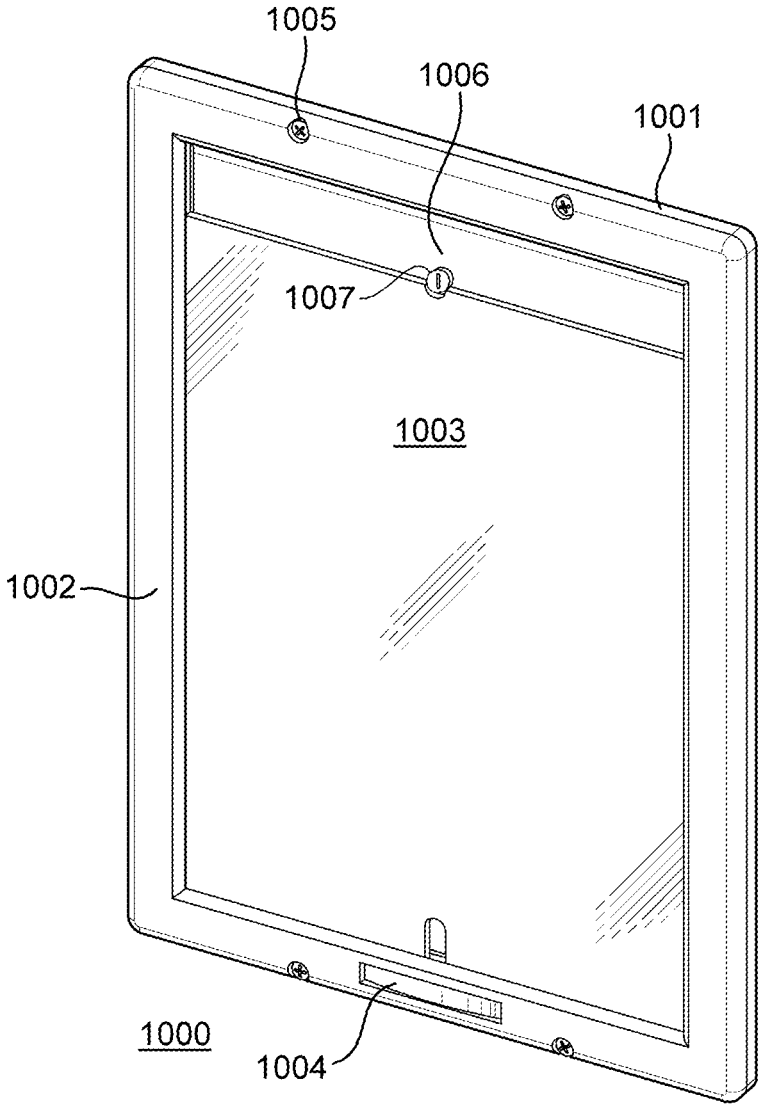
FIG. 12 perspective view of a display panel and divider section in accordance with an embodiment of the present invention.

FIG. 12 shows a close-up view of a single divided section 1000 in accordance with an embodiment of the present invention. In this view, the divided section 1000 is comprised of a back frame portion 1001, a front frame portion 1002 and a display panel 1003 in such a manner that a top opening 1006 is present and is capable of receiving documents there through. An attachment means 1005 is present at the top and bottom of the divided section for retaining the single divided section to a surface. This embodiment is further comprised of a label system 1004 and a locking element 1007.

Figure 13:
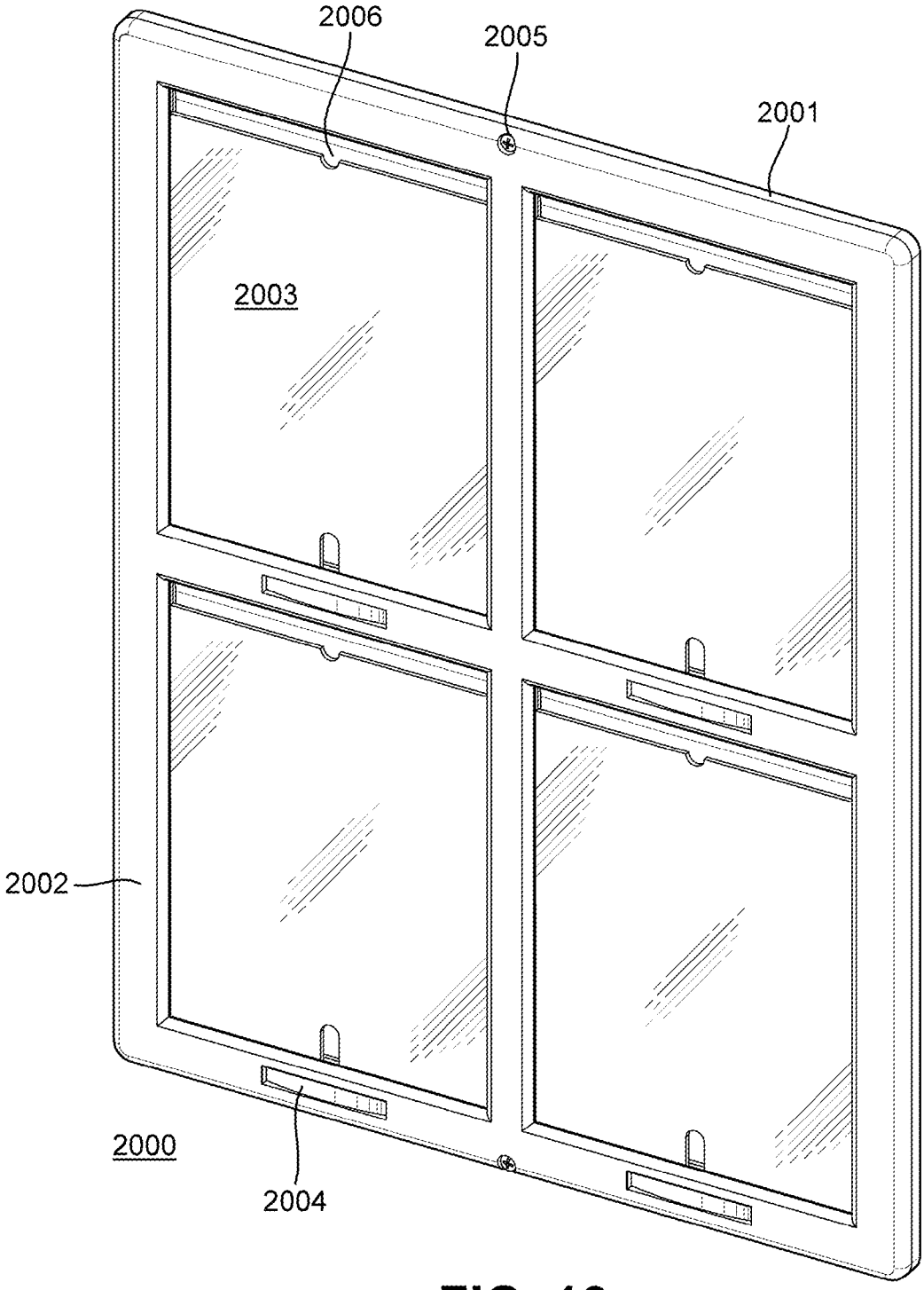
FIG. 13 is a perspective view of multiple display panels and divider sections in accordance with an embodiment of the present invention.
Figure 14:
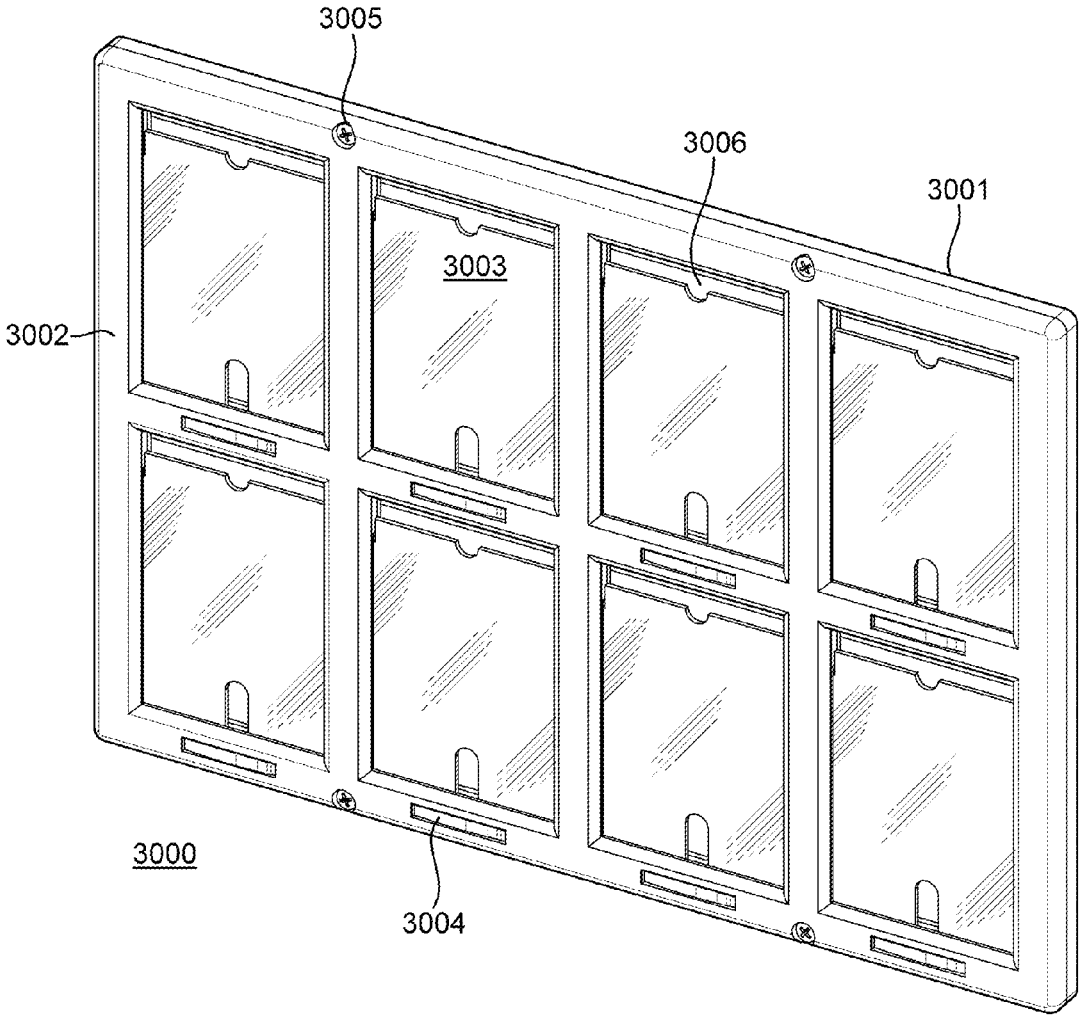
FIG. 14 is a perspective view of multiple display panels and divider sections in accordance with an embodiment of the present invention.
Figure 15:
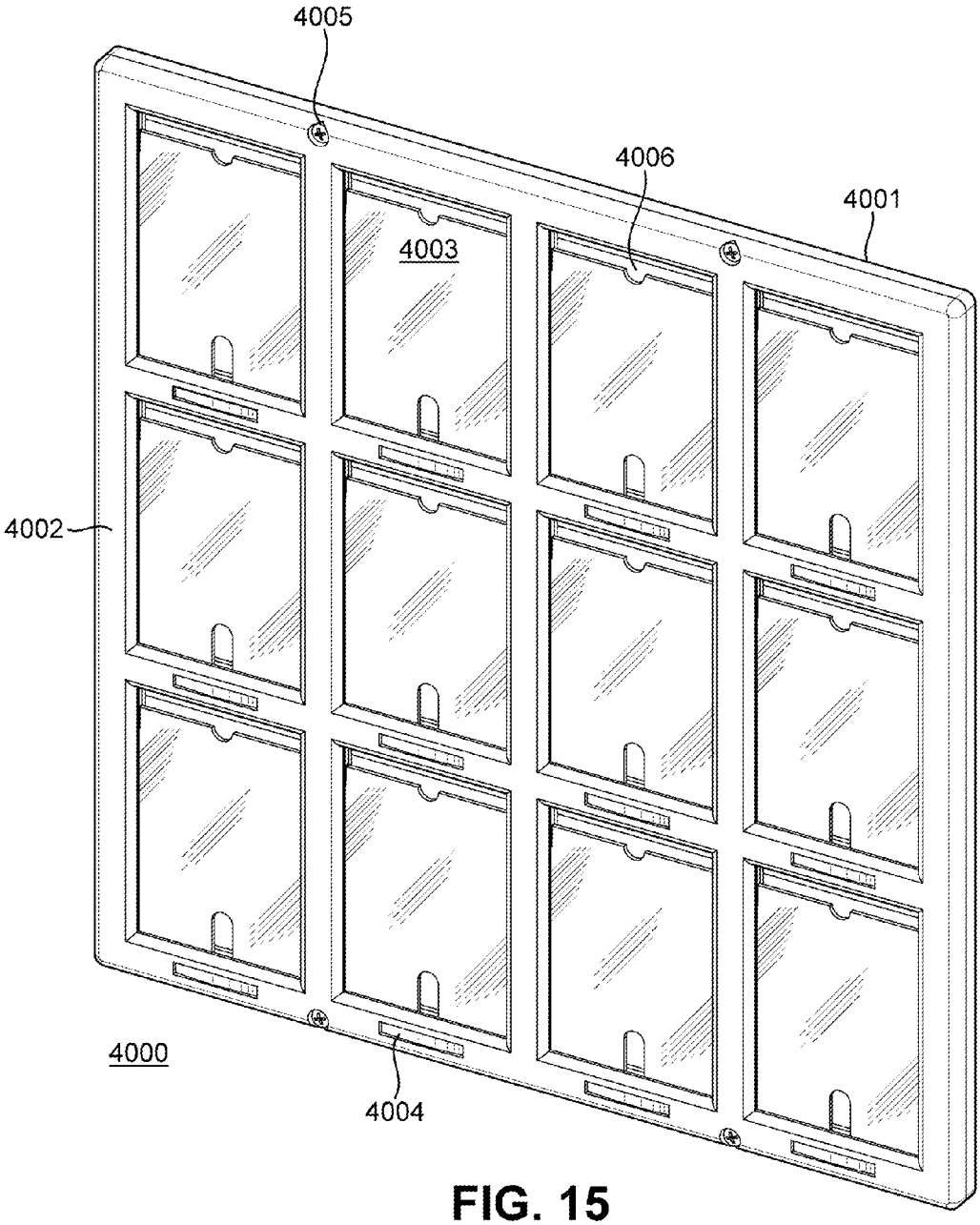
FIG. 15 is a perspective view of multiple display panels and divider sections in accordance with an embodiment of the present invention.

FIGS. 13-15 show views of alternate embodiments of the present invention. FIG. 13 shows an embodiment comprising four divided sections. In FIG. 13, the notification board 2000 is comprised of a back frame portion 2001, a front frame portion 2002 and display panels 2003 connected in such a manner that a top opening 2006 is present in each divided section/display panel combination and is capable of receiving documents there through. Further, FIG. 13 shows a label system 2004 and attachment means 2005 in accordance with descriptions provided herein.

FIG. 14 shows an embodiment comprising eight divided sections. In FIG. 14, the notification board 3000 is comprised of a back frame portion 3001, a front frame portion 3002 and display panels 3003 in such a manner that a top opening 3006 is present in each divided section/display panel combination and is capable of receiving documents there through. Further, FIG. 14 shows a label system 3004 and attachment means 3005 in accordance with descriptions provided herein.

FIG. 15 shows an embodiment comprising twelve divided sections. In FIG. 15, the notification board 4000 is comprised of a back frame portion 4001, a front frame portion 4002 and display panels 4003 in such a manner that a top opening 4006 is present in each divided section/display panel combination and is capable of receiving documents there through. Further, FIG. 15 shows a label system 4004 and attachment means 4005 in accordance with descriptions provided herein. One of ordinary skill in the art would appreciate that embodiments of the present invention could be created with any number of divided sections, and embodiments of the present invention are contemplated for use with any number of divided sections.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A notification board, said notification board comprising:
a back frame portion comprising a rear side and a front side,
wherein said rear side of said back frame portion is configured to be attached to a surface via one or more connection means;
a front frame portion comprising one or more divider sections,
wherein said front frame portion is connected to said front side of said back frame portion;
one or more solid transparent panes,
wherein each of said one or more solid transparent panes are secured in between one of said one or more divider sections of said front frame portion and said front side of said back frame portion and configured to slide between an open position and closed position; and
one or more tension means,
wherein each of said one or more tension means is in contact with at least one of said one or more solid transparent panes and at least one of said one or more divider sections.

2. The notification board of claim 1, wherein said front frame portion further comprises one or more labeling components.

3. The notification board of claim 2, wherein there are an equal number of labeling components and divider sections.

4. The notification board of claim 2, wherein each of said labeling component is formed in a recess on said one or more divider sections.

5. The notification board of claim 4, wherein there is exactly one labeling component on each horizontal portion of said one or more divider sections that is located beneath each of said solid transparent panes.

6. The notification board of claim 1, wherein said one or more dividers sections form a single integrated piece.

7. The notification board of claim 1, wherein a space is formed between each of said one or more dividers, at least one of said solid transparent panes and said front side of said back frame portion.

8. The notification board of claim 7, wherein said each space further comprises an open top portion formed by a curved portion located at the top of said divider that forms said space.

9. The notification board of claim 7, wherein said space is configured to receive one or more documents.

10. The notification board of claim 1, wherein each of said tension means is configured to place force upon said solid transparent pane which said tension means is in contact with in a manner that urges said solid transparent pane towards said closed position.

11. The notification board of claim 10, wherein said tension means is configured to allow opposing force to be applied thereto in order to move said solid transparent pane towards said open position.

12. The notification board of claim 11, wherein contents located behind said solid transparent pane may be removed from a bottom side of said divider section when said solid transparent pane is in said open position.

13. The notification board of claim 1, wherein said tension means is a spring.

14. The notification board of claim 1, further comprising one or more locking elements, attached to one or more of said one or more solid transparent panes and one or more of said divider sections.

15. The notification board of claim 14, wherein said each one of said one or more locking elements is configured to prevent movement of one of the one or more solid transparent panes.

16. The notification board of claim 1, wherein the solid transparent panes comprise polycarbonate plastic.

17. The notification board of claim 1, wherein one or more finger slots are formed on each of the solid transparent panes.

18. The notification board of claim 17, wherein at least one of the finger slots is formed at a top edge of each of the solid transparent panes.

19. The notification board of claim 17, wherein at least one of the finger slots is formed at a bottom edge of each of the solid transparent panes.

* * * * *